US010851678B2

(12) United States Patent
Takahashi et al.

(10) Patent No.: US 10,851,678 B2
(45) Date of Patent: Dec. 1, 2020

(54) THERMAL ENERGY RECOVERY DEVICE AND STARTUP OPERATION METHOD FOR THE SAME

(71) Applicant: KOBE STEEL, LTD., Hyogo (JP)

(72) Inventors: Kazuo Takahashi, Kobe (JP); Haruyuki Matsuda, Kobe (JP); Shigeto Adachi, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 16/464,696

(22) PCT Filed: Nov. 15, 2017

(86) PCT No.: PCT/JP2017/041132
§ 371 (c)(1),
(2) Date: May 29, 2019

(87) PCT Pub. No.: WO2018/101043
PCT Pub. Date: Jun. 7, 2018

(65) Prior Publication Data

US 2019/0383177 A1 Dec. 19, 2019

(30) Foreign Application Priority Data

Dec. 2, 2016 (JP) ..... 2016-234901

(51) Int. Cl.
*F01K 25/10* (2006.01)
*F01K 13/02* (2006.01)
(Continued)

(52) U.S. Cl.
CPC ..... *F01K 25/10* (2013.01); *F01K 13/02* (2013.01); *F22B 1/16* (2013.01); *F22B 1/18* (2013.01); *F22D 1/00* (2013.01)

(58) Field of Classification Search
CPC .... F01D 19/00; F01D 19/02; F01D 21/00–20; F01K 1/16; F01K 3/22; F01K 13/02
(Continued)

(56) References Cited

U.S. PATENT DOCUMENTS

2012/0031096 A1 2/2012 Ulas Acikgoz et al.
2012/0285167 A1* 11/2012 Horek ..... F28D 9/00 60/618

(Continued)

FOREIGN PATENT DOCUMENTS

DE 102011004263 A1 8/2012
JP S57099223 A 6/1982

(Continued)

OTHER PUBLICATIONS

International Preliminary Report on Patentability and Written Opinion issued in PCT/JP2017/041132; dated Jun. 13, 2019.

(Continued)

*Primary Examiner* — Mark A Laurenzi
*Assistant Examiner* — Mickey H France
(74) *Attorney, Agent, or Firm* — Studebaker & Brackett PC

(57) ABSTRACT

A thermal energy recovery device includes a circulation flow path for circulating a working fluid, a thermal fluid circulation flow path for circulating hot water, an evaporator for evaporating the working fluid flowing in the circulation flow path by heat of the hot water flowing in the thermal fluid circulation flow path, a preheater for heating the working fluid before flowing into the evaporator by the heat of the hot water flowing in the thermal fluid circulation flow path, and a control unit for controlling a startup operation of the thermal energy recovery device. The control unit executes a suppression control for suppressing a temperature difference between the hot water and the working fluid in the preheater.

4 Claims, 10 Drawing Sheets

(51) Int. Cl.
*F22B 1/16* (2006.01)
*F22B 1/18* (2006.01)
*F22D 1/00* (2006.01)

(58) Field of Classification Search
USPC ..... 60/646, 656, 657
See application file for complete search history.

(56) References Cited

U.S. PATENT DOCUMENTS

| | | | | |
|---|---|---|---|---|
| 2013/0047614 | A1 | 2/2013 | Gaia et al. | |
| 2015/0013335 | A1* | 1/2015 | Carstensen | F28D 9/0093 60/618 |
| 2016/0047540 | A1 | 2/2016 | Aumann et al. | |
| 2017/0284230 | A1* | 10/2017 | Juchymenko | F01K 23/065 |
| 2019/0226364 | A1* | 7/2019 | Giraud | F27D 17/004 |

FOREIGN PATENT DOCUMENTS

| | | | |
|---|---|---|---|
| JP | S58-065917 | | 4/1983 |
| JP | S58-104401 | | 6/1983 |
| JP | S62096704 | A | 5/1987 |
| JP | H01-237309 | A | 9/1989 |
| JP | 2014047632 | A | 3/2014 |

OTHER PUBLICATIONS

The extended European search report issued by the European Patent Office on May 27, 2020, which corresponds to European Patent Application No. 17875253.1-1008 and is related to U.S. Appl. No. 16/464,696.

* cited by examiner

THERMAL ENERGY RECOVERY DEVICE AND STARTUP OPERATION METHOD FOR THE SAME

TECHNICAL FIELD

The present invention relates to a thermal energy recovery device and a startup operation method for the same.

BACKGROUND ART

Conventionally, a thermal energy recovery device is known which recovers power from a heating medium such as exhaust gas discharged from various facilities such as factories. For example, patent literature 1 discloses a power generation device (thermal energy recovery device) with an evaporator, a preheater, an expander, a power generator, a condenser, a working fluid pump and a circulation flow path. The evaporator heats a working fluid with a heating medium supplied from an external heat source. The preheater heats the working fluid before flowing into the evaporator with the heating medium flowing out from the evaporator. The expander expands the working fluid flowing out from the evaporator. The power generator is connected to the expander. The condenser condenses the working fluid flowing out from the expander. The working fluid pump feeds the working fluid condensed in the condenser to the preheater. The circulation flow path connects the preheater, the evaporator, the expander, the condenser and the pump.

In the thermal energy recovery device described in the above literature 1, if the high-temperature heating medium is supplied to the evaporator, the temperature of the evaporator suddenly increases at the time of starting the operation of this recovery device, whereby a thermal stress generated in the evaporator may suddenly increase. Specifically, before the operation of the recovery device is started, the temperature of the evaporator is relatively low, whereas thermal energy of the heating medium such as steam is very large. Thus, if the high-temperature heating medium flows into the evaporator at the time of starting the operation, the temperature of the evaporator may suddenly increase.

CITATION LIST

Patent Literature

Patent Literature 1: Japanese Unexamined Patent Publication No. 2014-47632

SUMMARY OF INVENTION

An object of the present invention is to provide a thermal energy recovery device capable of suppressing a sudden increase of a thermal stress generated in an evaporator at the time of starting an operation and a startup operation method for the same.

To achieve the above object, a thermal energy recovery device according to one aspect of the present invention includes a working fluid circulation flow path for circulating a working fluid, a thermal fluid circulation flow path for circulating a pressurized heating fluid in a liquid state, an evaporation unit for evaporating the working fluid flowing in the working fluid circulation flow path by heat of the heating fluid flowing in the thermal fluid circulation flow path, and a control unit for controlling a startup operation of the thermal energy recovery device. The control unit executes a suppression control for suppressing a temperature difference between the heating fluid and the working fluid in the evaporation unit in the startup operation.

A startup operation method for thermal energy recovery device according to one aspect of the present invention is a startup operation method for thermal recovery device with an evaporation unit for evaporating a working fluid flowing in a working fluid circulation flow path by heat of a heating fluid flowing in a thermal fluid circulation flow path, wherein a suppression control for suppressing a temperature of the working fluid in the evaporation unit is executed in a startup operation of the thermal energy recovery device.

DESCRIPTION OF EMBODIMENTS

First Embodiment

A thermal energy recovery device according to a first embodiment of the present invention is described with reference to the drawings.

Figure 1:
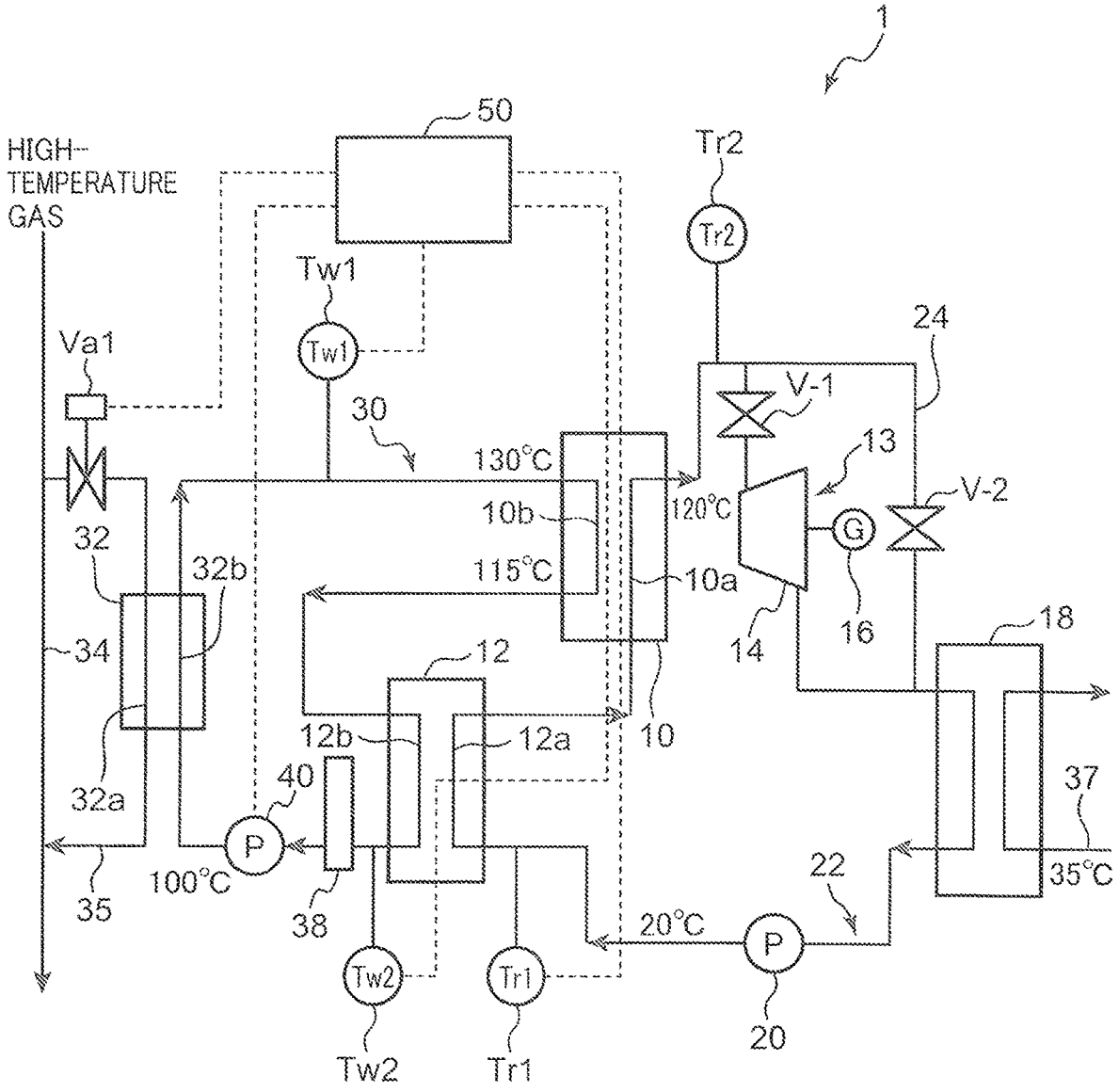
FIG. 1 is a diagram showing a schematic configuration of a thermal energy recovery device according to a first embodiment of the present invention.

As shown in FIG. 1, the thermal energy recovery device 1 includes a working fluid circulation flow path for circulating a working fluid while being accompanied by a phase change (hereinafter, merely referred to as a "circulation flow path") 22, a thermal fluid circulation flow path 30 for circulating hot water serving as a pressurized heating fluid in a liquid state, and a control unit 50.

A heater 32 is provided in the thermal fluid circulation flow path 30. This heater 32 includes a heating medium flow path 32*a* in which a heating medium (high-temperature gas such as corrosive gas) in a gas phase flows and a thermal fluid flow path 32*b* in which hot water flows. The heating medium in the heating medium flow path 32*a* and the hot water in the thermal fluid flow path 32*b* exchange heat in the heater 32. In this way, the hot water is heated. The thermal energy recovery device 1 recovers thermal energy of the heating medium. In the recovery device 1, this thermal energy of the heating medium is temporarily recovered in the hot water of the thermal fluid circulation flow path 30.

Since the thermal fluid circulation flow path 30 is interposed between a pipe 34 in which the heating medium flows and the circulation flow path 22 in which the working fluid is circulated, the heating medium does not flow into later-described evaporator 10 and preheater 12 provided in the circulation flow path 22. Thus, even if the heating medium is corrosive gas, the corrosion of the evaporator 10 and the preheater 12 can be prevented.

The heating medium flow path 32*a* is connected to a heating pipe 35 branched from the pipe 34 in which the heating medium flows. A flow rate of the heating medium flowing into the heater 32 can be adjusted by changing an opening of a flow rate control value Va1 provided in the heating pipe 35. Note that the flow rate control valve Va1 may be arranged upstream of the heater 32 in the heating pipe 35 or may be arranged downstream of the heater 32.

The evaporator 10, the preheater 12, an energy recovery unit 13, a condenser 18 and a pump 20 are provided in the circulation flow path 22.

The evaporator 10 includes a first flow path 10*a* in which the working fluid flows and a second flow path 10*b* in which the hot water flows. The evaporator 10 performs heat exchange between the hot water in the thermal fluid circulation flow path 30 and the working fluid (HFC245fa or the like) in the circulation flow path 22. In this way, the working fluid evaporates. In this embodiment, a brazing plate type heat exchanger is used as the evaporator 10. However, a so-called shell-and-tube type heat exchanger may be used as the evaporator 10.

The preheater 12 is arranged between the evaporator 10 and the pump 20 in the circulation flow path 22. The preheater 12 includes a first flow path 12*a* in which the working fluid flows and a second flow path 12*b* in which the hot water flows. The preheater 12 performs heat exchange between the hot water flowing out from the evaporator 10 and the working fluid before flowing into the evaporator 10. In this way, the working fluid is heated. In this embodiment, a brazing plate type heat exchanger is used also as the preheater 12. However, a so-called shell-and-tube heat exchanger may be used as the preheater 12 as in the case of the evaporator 10.

Figure 5:
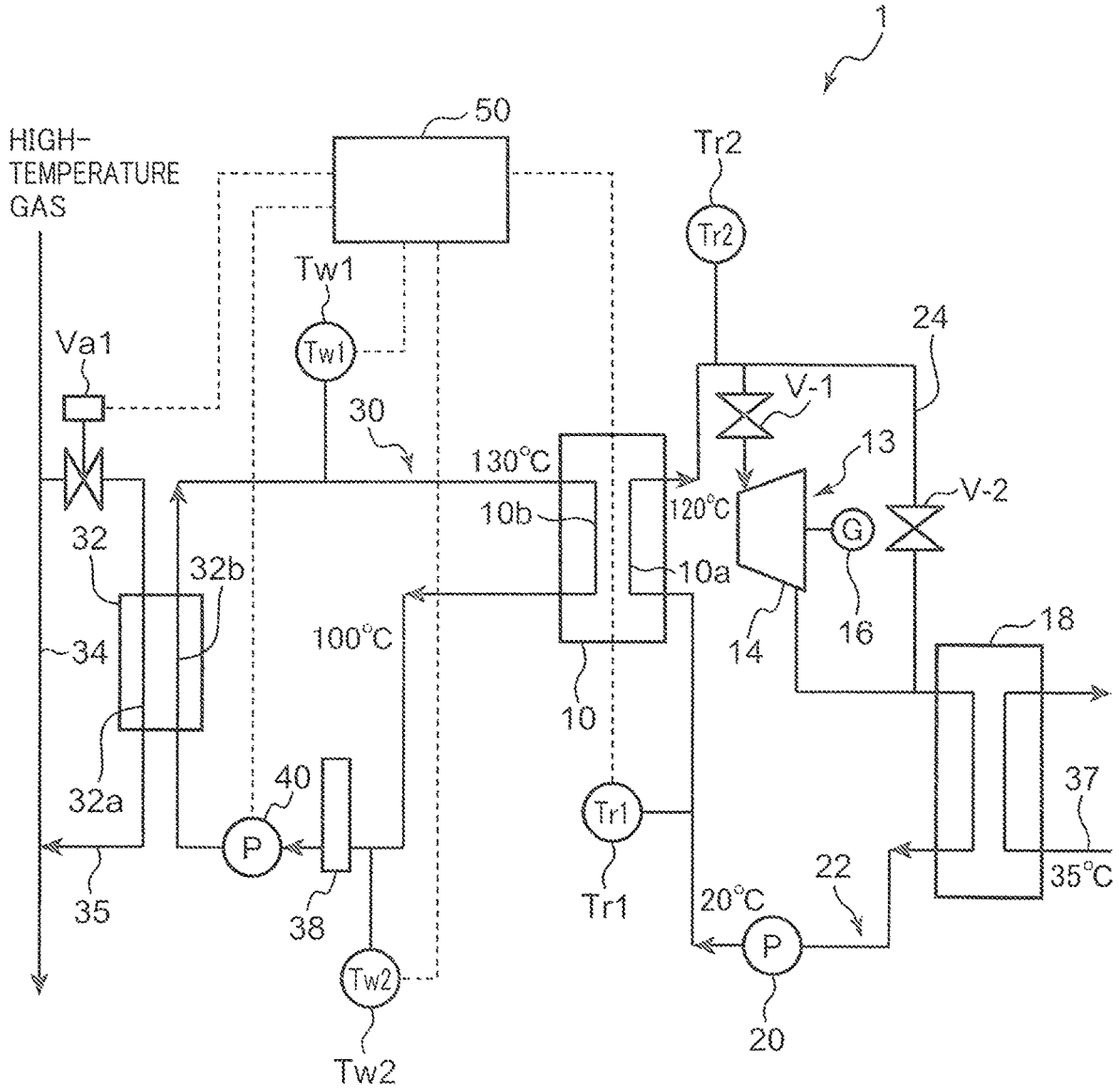
FIG. 5 is a diagram showing a schematic configuration of a thermal energy recovery device according to a modification of the first embodiment of the present invention.

In the first embodiment, an evaporation unit for evaporating the working fluid includes the evaporator 10 and the preheater 12 provided separately from the evaporator 10. However, there is no limitation to this. As shown in FIG. 5, the evaporator 10 functioning as the evaporation unit may be provided, whereas the preheater may be omitted.

The energy recovery unit 13 includes an expander 14 and a power recovery device 16. The expander 14 is provided in a part of the circulation flow path 22 downstream of the evaporator 10. Thus, the preheater 12, the evaporator 10, the expander 14, the condenser 18 and the pump 20 are connected to the circulation flow path 22 in this order. The expander 14 expands the working fluid in a gas phase flowing out from the evaporator 10. In this embodiment, a positive displacement screw expander including a rotor to be rotationally driven by expansion energy of the working fluid in a gas phase flowing out from the evaporator 10 is used as the expander 14. Specifically, the expander 14 includes a pair of male and female screw rotors.

The power recovery device 16 is connected to the expander 14. In this embodiment, a power generator is used as the power recovery device 16. This power recovery device 16 includes a rotary shaft connected to one of the pair of screw rotors of the expander 14. The power recovery device 16 generates power as the rotary shaft rotates according to the rotation of the screw rotor. Note that, instead of the power generator, a compressor or the like may be used as the power recovery device 16.

An isolation valve V-1 is provided in a part of the circulation flow path 22 between the evaporator 10 and the expander 14. Further, a bypass flow path 24 bypassing the isolation valve V-1 and the expander 14 is provided in the circulation flow path 22. An on-off valve V-2 is provided in the bypass flow path 24.

The condenser 18 is provided in a part of the circulation flow path 22 downstream of the expander 14. The condenser 18 condenses (liquefies) the working fluid flowing out from the expander 14 by cooling the working fluid with a cooling medium (cooling water or the like) supplied from outside. The cooling medium is supplied through a cooling medium flow path 37, for example, from a cooling tower connected to the cooling medium flow path 37.

The pump 20 is provided in a part of the circulation flow path 22 downstream of the condenser 18 (part between the condenser 18 and the preheater 12). The pump 20 pressurizes the working fluid in a liquid phase to a predetermined pressure and feeds the pressurized working fluid to the preheater 12. A centrifugal pump including an impeller as a rotor, a gear pump including a rotor composed of a pair of gears, a screw pump, a trochoid pump or the like is used as the pump 20.

The heating fluid is sealed in a pressurized state in the thermal fluid circulation flow path 30. Specifically, the hot water is sealed in a pressurized state in the thermal fluid circulation flow path 30. Further, the evaporator 10, the preheater 12, a buffer tank 38, a fluid pump 40 and the heater 32 are arranged in this order in the thermal fluid circulation flow path 30. The hot water successively flows through the evaporator 10, the preheater 12, the buffer tank 38, the fluid pump 40 and the heater 32. The buffer tank 38 is provided on a suction side of the fluid pump 40. By providing the buffer tank 38, a predetermined pressure (head pressure) can be applied to the suction side of the fluid pump 40.

The thermal energy recovery device 1 is provided with an inlet-side working fluid temperature sensor Tr1, an outlet-side working fluid temperature sensor Tr2, an inlet-side hot water temperature sensor Tw1 and an outlet-side hot water temperature sensor Tw2. The inlet-side working fluid temperature sensor Tr1 detects a temperature of the working fluid on an inlet side of the evaporation unit, i.e. the preheater 12 and outputs a signal indicative of a detection value. The outlet-side working fluid temperature sensor Tr2 detects a temperature of the working fluid on an outlet side of the evaporation unit, i.e. the evaporator 10 and outputs a signal indicative of a detection value. The inlet-side hot water temperature sensor Tw1 detects a temperature of the hot water on an inlet side of the evaporation unit, i.e. the evaporator 10 and outputs a signal indicative of a detection value. The outlet-side hot water temperature sensor Tw2 detects a temperature of the hot water on an outlet side of the evaporation unit, i.e. the preheater 12 and outputs a signal indicative of a detection value.

Figure 2:
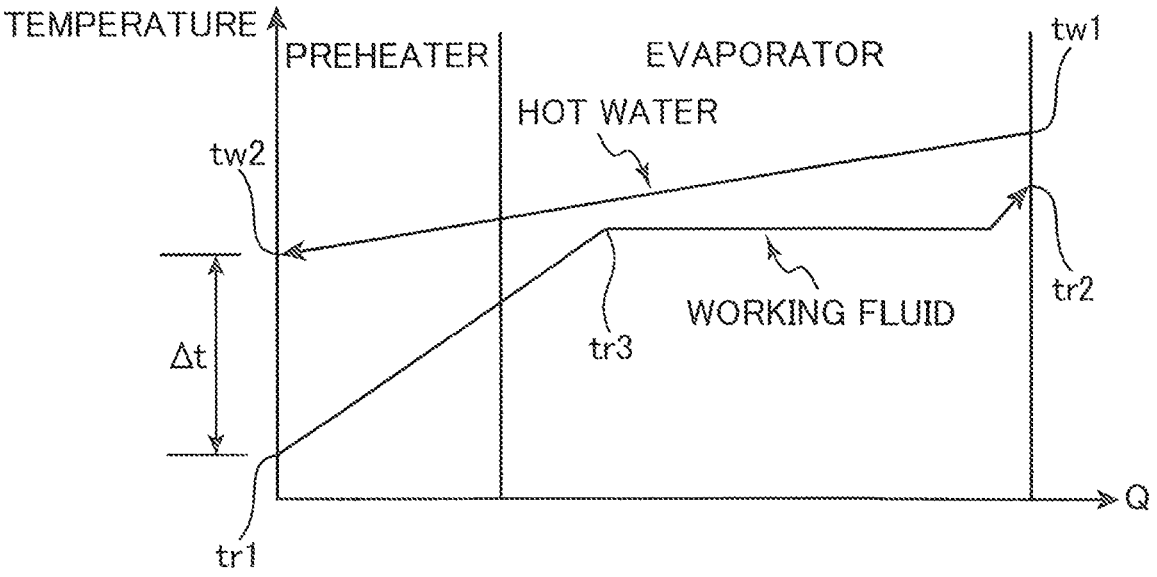
FIG. 2 is a graph showing temperature transitions of a working fluid and hot water in the thermal energy recovery device.

The signals output from these sensors Tr1, Tr2, Tw1 and Tw2 are input to the control unit 50. The control unit 50 executes a suppression control for suppressing a temperature difference between the hot water and the working fluid in the evaporator 10 and the preheater 12 during a startup operation of the thermal energy recovery device 1. As shown in FIG. 2, the temperature of the working fluid increases from a temperature tr1 on the inlet side of the preheater 12 to a temperature tr3 by being heated by the hot water in the preheater 12 and the evaporator 10. Then, the working fluid evaporated in the evaporator 10 is further heated in the evaporator 10 to reach a temperature tr2. In contrast, the temperature of the hot water gradually decreases from a temperature tw1 on the inlet side of the evaporator 10 and reaches a temperature tw2 on the outlet side of the preheater 12. Since the working fluid undergoes a phase change in the evaporator 10, a temperature change amount is small. In contrast, a temperature change amount of the working fluid is large in the preheater 12. Thus, a temperature difference Δt between the temperature tw2 of the hot water on the outlet side of the preheater 12 and the temperature tr1 of the working fluid on the inlet side of the preheater 12 increases. Particularly, since the temperature of the working fluid is low in some cases during the startup operation, the temperature difference Δt tends to increase and a thermal stress generated in the preheater 12 possibly becomes problematic.

Accordingly, the control unit 50 executes the suppression control for suppressing the temperature difference between the hot water and the working fluid in the evaporator 10 and the preheater 12 during the startup operation.

Figure 3:
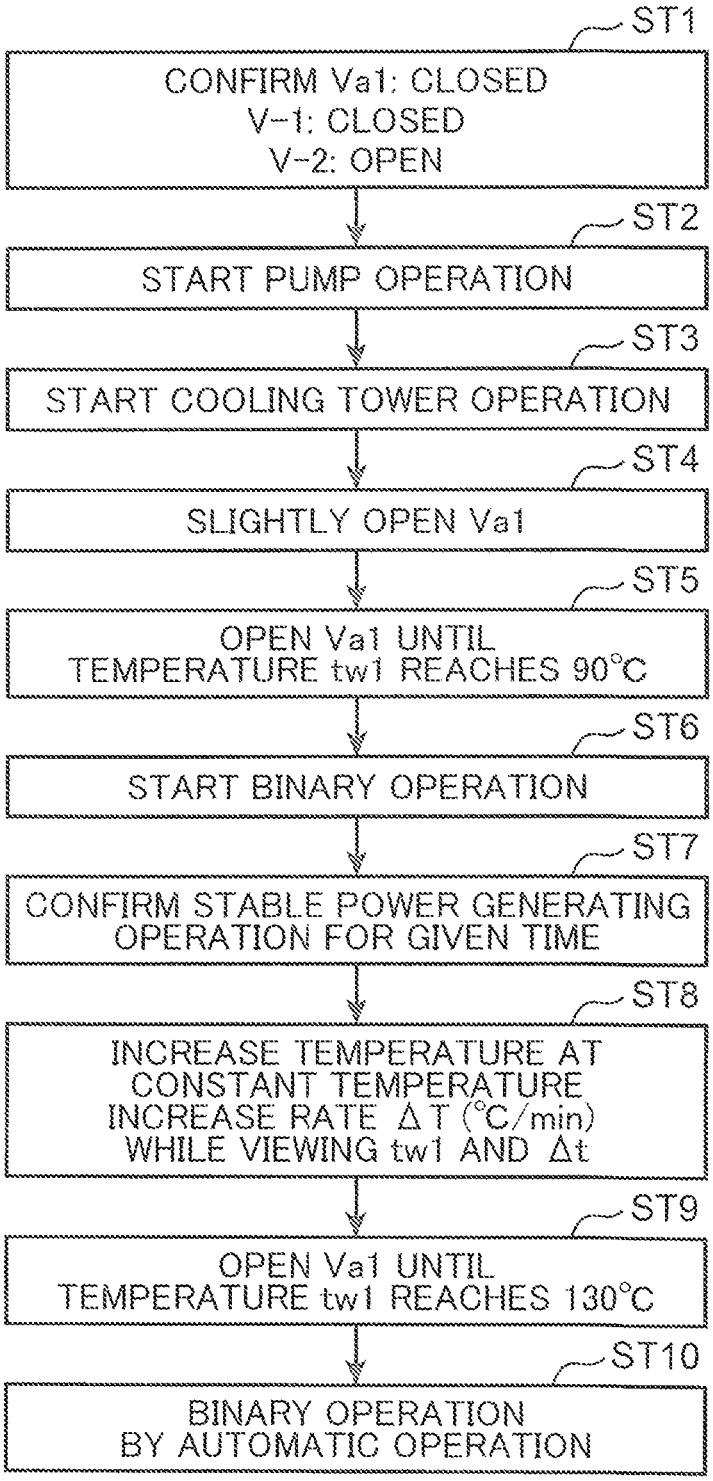
FIG. 3 is a chart showing a control operation of a startup operation of the thermal energy recovery device.

Next, a control operation of the startup operation is described with reference to FIG. 3. During the startup operation for starting the thermal energy recovery device 1, an operator first confirms that the flow rate control valve Va1 is closed, the isolation valve V-1 is closed and the on-off valve V-2 in the bypass flow path 24 is open (Step ST1). Then, the operator operates an unillustrated start button. In this way, the pump 20 and the fluid pump 40 start operating (Step ST2). Further, the operation of the cooling tower is started, whereby the cooling medium is supplied to the condenser 18 through the cooling medium flow path 37 (Step ST3).

Subsequently, the control unit 50 controls to slightly open the flow rate control valve Va1 (Step ST4). At this time, the opening is set at a value set in advance such as α %. The control unit 50 controls to gradually increase the opening of the flow rate control valve Va1 (Step ST5). In this way, the temperature of the hot water gradually increases. At this time, the temperature tw1 of the hot water on the inlet side of the evaporator 10 is monitored by the inlet-side hot water temperature sensor Tw1. The control unit 50 gradually increases the opening of the flow rate control valve Va1 until the temperature reaches an operation start temperature (e.g. 90° C.) set in advance. However, the operation start temperature is not limited to 90° C. and, for example, a range of about ±5° C. is allowed. When the temperature tw1 of the hot water on the inlet side of the evaporator 10 reaches the operation start temperature, the control unit 50 opens the isolation valve V-1 and closes the on-off valve V-2 in the bypass flow path 24. In this way, the expander 14 is driven to start power recovery by the power recovery device 16 (Step ST6). Then, it is confirmed whether or not the operation (power generation) has been continuously stably performed for a given time (Step ST7).

After the drive of the expander 14 is started, the control unit 50 controls to gradually increases the opening of the flow rate control valve Va1 with the temperatures monitored by the respective temperature sensors Tr1, Tr2, Tw1 and Tw2 (Step ST8). At this time, a rate of increasing the opening of the flow rate control valve Va1 is so set that a temperature increase rate ΔT (C°/min) of the temperature tw1 of the hot water on the inlet side of the evaporator 10 is larger than a temperature increase rate when the temperature is below the operation start temperature.

In Step ST8, the temperature tw1 of the hot water on the inlet side of the evaporator 10 is monitored and, if the temperature tw1 of the hot water is below a temperature set in advance, the control unit 50 gradually increases the opening of the flow rate control valve Va1 as described above. If the temperature tw1 of the hot water is equal to or higher than the temperature set in advance, the temperature difference Δt between the temperature tw2 of the hot water on the outlet side of the preheater 12 and the temperature tr1 of the working fluid on the inlet side of the preheater 12 is also monitored. Then, the control unit 50 executes the suppression control to gradually increase the opening of the flow rate control valve Va1 in such a range where the temperature difference Δt does not exceed a value set in advance. In this way, the temperature tw1 of the hot water on the inlet side of the evaporator 10 gradually increases and the temperature tw2 of the hot water on the outlet side of the preheater 12 also gradually increases. On the other hand, the temperature difference Δt between the temperature tw2 and the temperature tr1 is suppressed to be equal to or lower than a predetermined temperature and does not become excessive. Specifically, an input heat quantity increase rate from the hot water in the evaporator 10 and the preheater 12 is suppressed. Thus, a thermal stress by the thermal expansion of the preheater 12 does not become excessive. Note that a rotation speed of the fluid pump 40 may also be adjusted in association with an opening adjustment of the flow rate control valve Va1. Specifically, the rotation speed of the fluid pump 40 may be adjusted to further finely adjust the temperature by the flow rate control valve Va1.

The control unit 50 judges whether or not the temperature tw1 of the hot water on the inlet side of the evaporator 10 has reached an operating temperature (e.g. 130° C.) set in advance (Step ST9) and the startup operation transitions to a normal operation by an automatic operation when the temperature tw1 reaches the operating temperature (Step ST10). In the normal operation, the temperature tw1 of the hot water on the inlet side of the evaporator 10 is, for example, about 130° C., and the temperature of the hot water on the outlet side of the evaporator 10 is, for example, about 115° C. Further, the temperature tw2 of the hot water on the outlet side of the preheater 12 is, for example, about 100° C. On the other hand, the temperature of the working fluid on the inlet side of the preheater 12 is, for example, about 20° C. at the start of the operation, but reaches, for example, about 40° C. during the normal operation. The temperature of the working fluid on the outlet side of the evaporator 10 is, for example, about 120° C.

Figure 4:
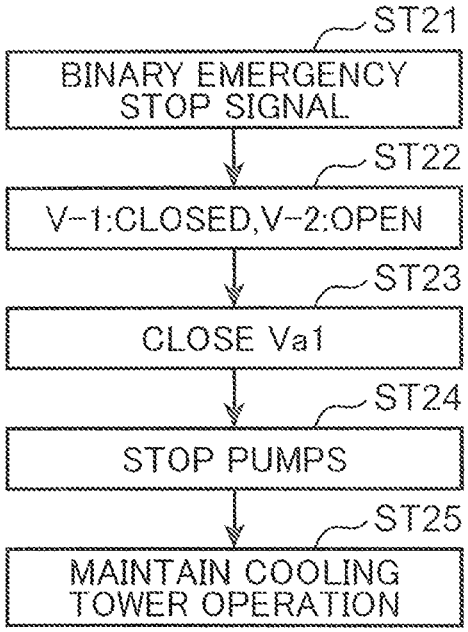
FIG. 4 is a chart showing a control operation of a stop operation of the thermal energy recovery device.

FIG. 4 shows a stop flow during the automatic operation. As shown in FIG. 4, when an emergency stop signal is issued (Step ST21), the control unit 50 closes the isolation valve V-1 and opens the on-off valve V-2 in the bypass flow path 24 (Step ST22). In this way, the working fluid bypasses the expander 14, wherefore power generation is stopped. Then, the flow rate control valve Va1 is closed (Step ST23). Since the temperature of the hot water circulating in the thermal fluid circulation flow path 30 decreases in this way, the input heat quantities to the evaporator 10 and the preheater 12 decrease. Then, the pump 20 and a hot water pump are stopped (Step ST24). At this time, the operation of the cooling tower is maintained (Step ST25).

As described above, in this embodiment, heat exchange is performed between the hot water introduced from the thermal fluid circulation flow path 30 and the working fluid introduced from the circulation flow path 22 in the evaporator 10 and the preheater 12. Since the pressurized hot water in a liquid state flows into the evaporator 10 and the preheater 12, thermal energy introduced to the evaporator 10 and the preheater 12 is large. Thus, in the startup operation in which the temperature of the working fluid is relatively low, the suppression control is executed to suppress the temperature difference between the hot water and the working fluid in the evaporator 10 and the preheater 12. Therefore, it can be suppressed that large thermal stresses are generated in the evaporator 10 and the preheater 12 during the startup operation.

Further, in this embodiment, if the temperature of the hot water is equal to or higher than the predetermined temperature set in advance, the input heat quantities in the evaporator 10 and the preheater 12 are suppressed such that the temperature difference Δt between the temperature tw2 of the hot water on the outlet side of the preheater 12 and the temperature tr1 of the working fluid on the inlet side of the preheater 12 is equal to or lower than the predetermined temperature. Thus, it can be reliably suppressed that the thermal stresses in the evaporator 10 and the preheater 12 become excessive at the start of the operation. Specifically, the temperature difference between the temperature tw2 of the hot water on the outlet side and the temperature tr1 of the working fluid on the inlet side is largest in the preheater 12. Thus, by executing the suppression control on the basis of this temperature difference between the both, it can be reliably suppressed that the terminal stress in the preheater 12 becomes excessive.

Further, in this embodiment, the control unit 50 adjusts the opening of the flow rate control valve Va1 in the startup operation, whereby the temperature difference Δt between the temperature tw2 of the hot water on the outlet side and the temperature tr1 of the working fluid on the inlet side is maintained to be equal to or lower than the predetermined temperature. Thus, it can be suppressed that the thermal stress in the preheater 12 becomes excessive by a simple operation of adjusting the opening of the flow rate control valve Va1.

Further, in this embodiment, the suppression control is executed to control the temperature difference Δt between the hot water and the working fluid in the startup operation. Thus, even if the temperature of the preheater 12 is relatively low before the startup operation, a sudden temperature increase of the preheater 12 can be suppressed. Therefore, it can be suppressed that the thermal stress generated in the preheater 12 suddenly increases at the start of the operation.

Second Embodiment

Figure 6:
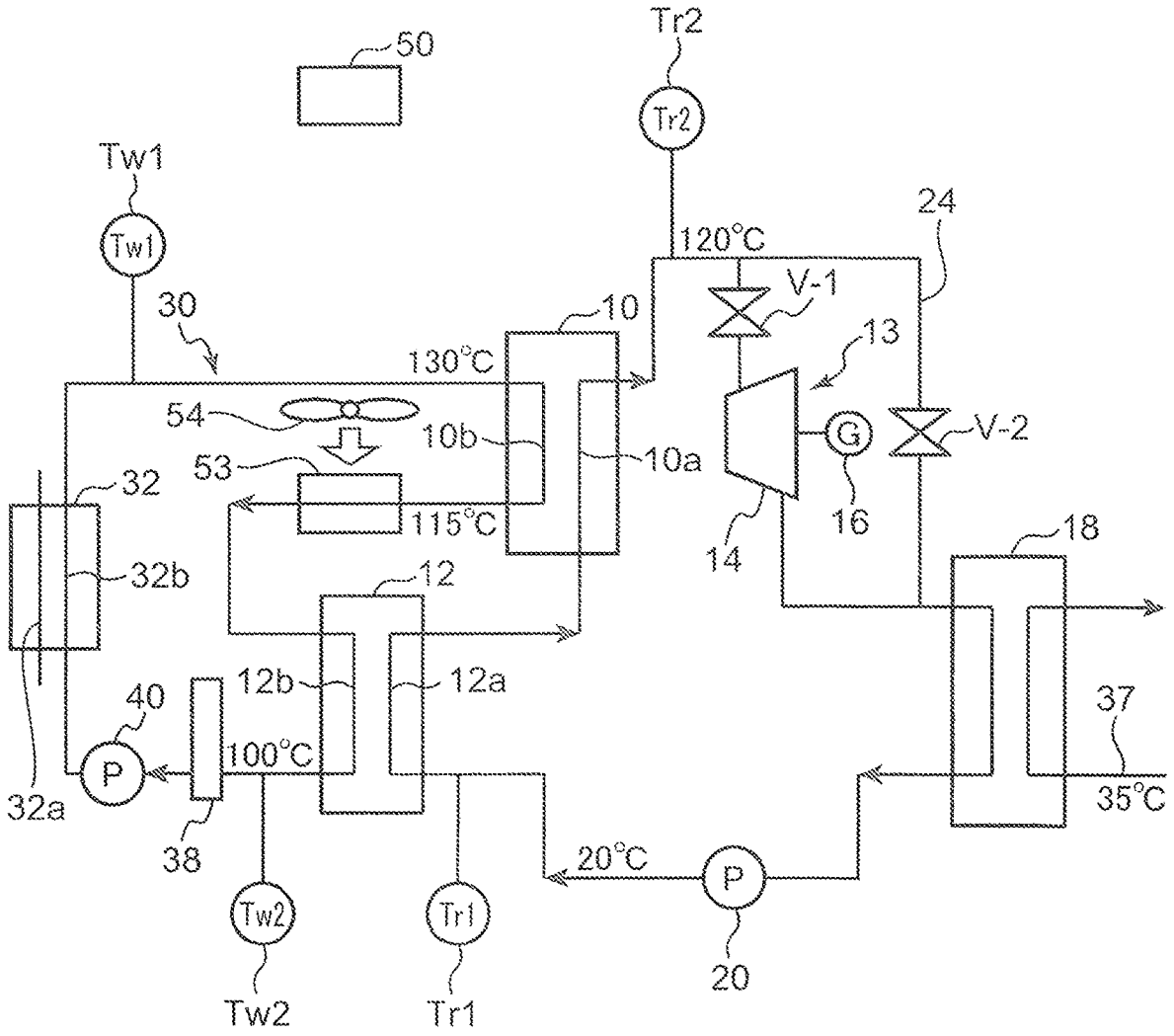
FIG. 6 is a diagram showing a schematic configuration of a thermal energy recovery device according to a second embodiment of the present invention.

FIG. 6 shows a second embodiment of the present invention. Note that the same constituent elements as in the first embodiment are denoted by the same reference signs and the detailed description thereof is omitted here.

In the second embodiment, a cooler 53 is provided in a thermal fluid circulation flow path 30 and a temperature difference Δt between a temperature tw2 of hot water on an outlet side of a preheater 12 and a temperature tr1 of a working fluid on an inlet side of the preheater 12 is reduced by operating the cooler 53.

The cooler 53 is for reducing the temperature of the hot water through heat exchange between a cooling medium (air, water or the like) and the hot water. If air is used as the cooling medium, a fan 54 for generating an air flow is provided. By driving the fan 54, the cooler 53 operates. In this way, the temperature difference Δt between the temperature tw2 of the hot water on the outlet side of the preheater 12 and the temperature tr1 of the working fluid on the inlet side is controlled to or below a predetermined temperature. Note that if water is used as the cooling medium, an unillustrated pump is provided and the cooler 53 operates by driving the pump.

Figure 7:
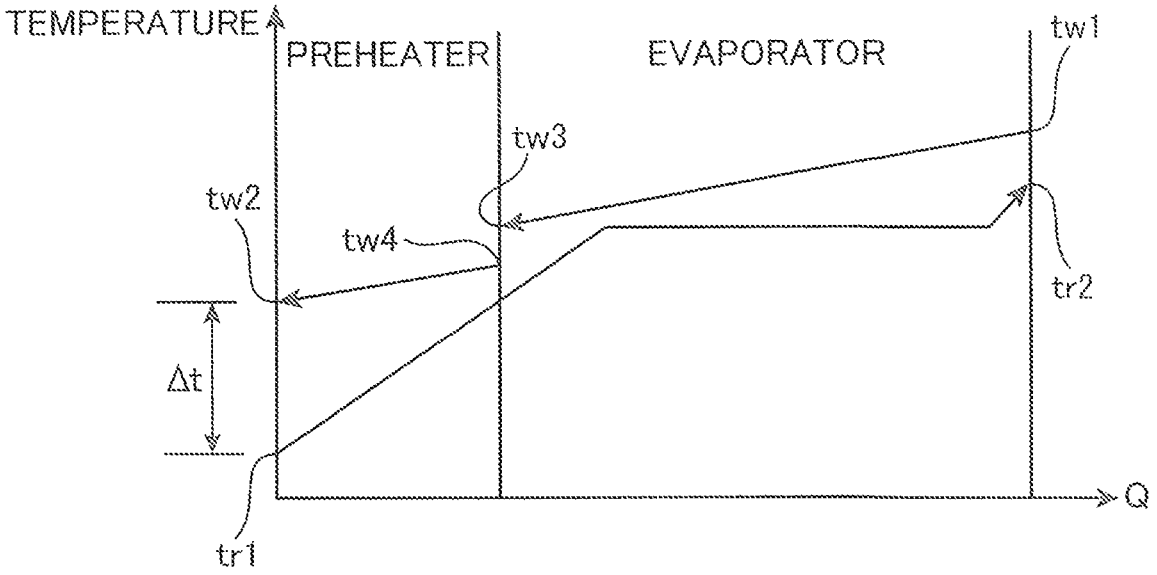
FIG. 7 is a graph showing temperature transitions of a working fluid and hot water in the thermal energy recovery device.

In the second embodiment, a temperature tw4 of the hot water on an inlet side of the preheater 12 becomes lower than a temperature tw3 of the hot water on an outlet side of the evaporator 10 as shown in FIG. 7 by operating the cooler 53. In this way, the temperature difference Δt between the temperature tw2 of the hot water on the outlet side of the preheater 12 and the temperature tr1 of the working fluid on the inlet side of the preheater 12 is suppressed to be equal to or lower than the predetermined temperature. Note that the temperature of the hot water exhibits a temperature transition shown in FIG. 2 in a state where the cooler 53 is not operated.

Figure 8:
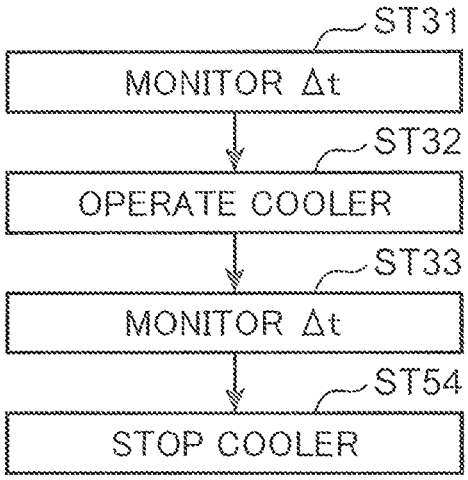
FIG. 8 is a chart showing a control operation of a normal operation of the thermal energy recovery device.

In the thermal energy recovery device 1 according to the second embodiment, whether or not the temperature difference Δt between the temperature tw2 of the hot water on the outlet side of the preheater 12 and the temperature tr1 of the working fluid on the inlet side of the preheater 12 is equal to or lower than the temperature set in advance during the normal operation is monitored by the control unit 50 (Step ST31) as shown in FIG. 8. If the temperature difference Δt is judged to have exceeded the temperature set in advance, the control unit 50 operates the cooler 53 (Step ST32). In this way, the temperature on the inlet side of the preheater 12 decreases to reduce the temperature difference Δt between the temperature tw2 of the hot water on the outlet side of the preheater 12 and the temperature tr1 of the working fluid on the inlet side of the preheater 12. If the temperature difference Δt is further monitored and judged to be within the temperature set in advance, the control unit 50 stops the cooler 53 (Step ST54).

As just described, in the second embodiment, the control unit 50 operates the cooler 53 if the temperature difference Δt between the hot water and the working fluid exceeds the predetermined temperature. In this way, the temperature of the hot water flowing in the thermal fluid circulation flow path 30 decreases. Thus, the temperature difference Δt between the hot water and the working fluid in the preheater 12 can be reduced.

Note that the other configurations, functions and effects are not described, but are the same as in the first embodiment.

Figure 9:
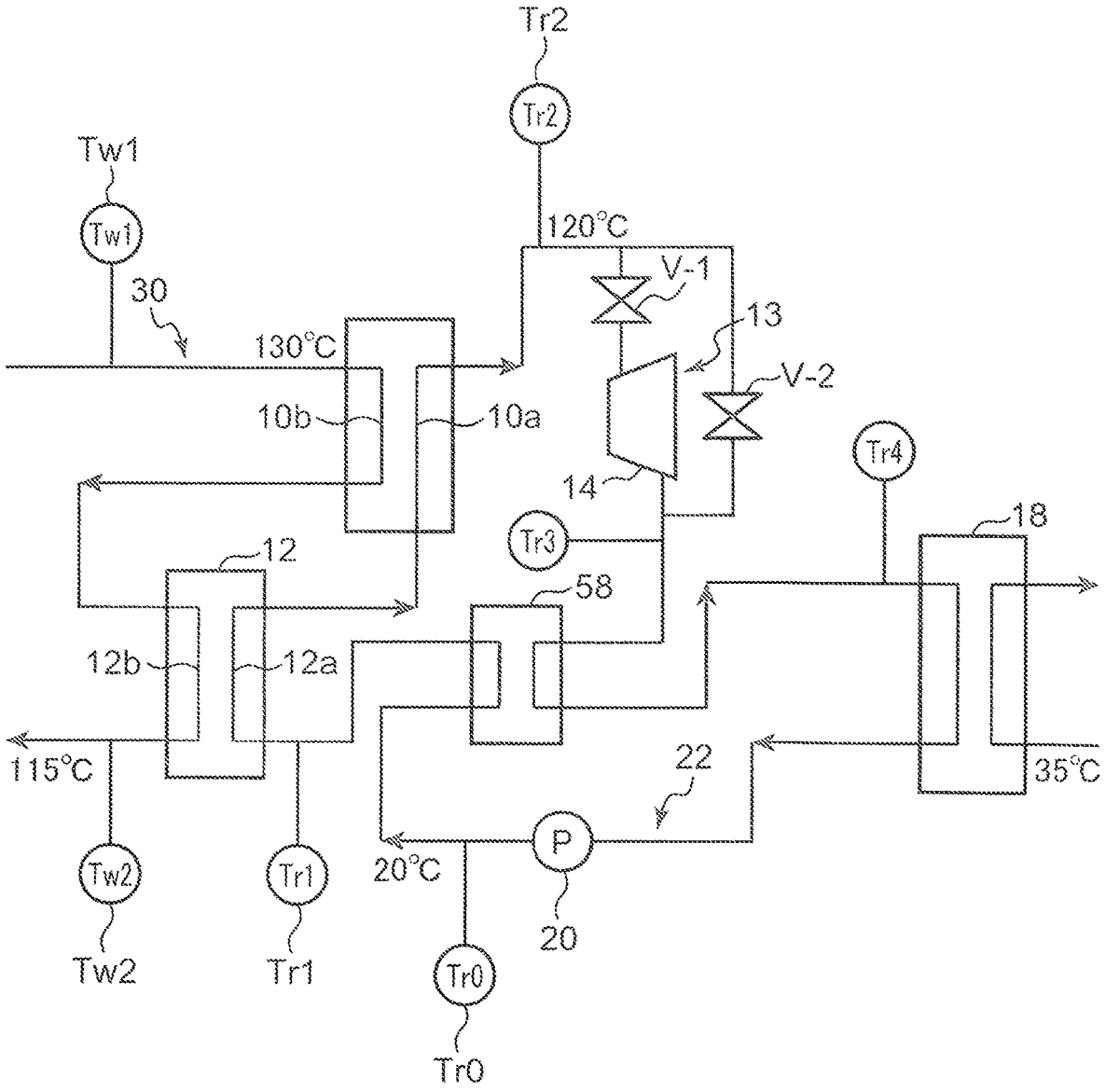
FIG. 9 is a diagram showing a schematic configuration of a thermal energy recovery device as a reference example.
Figure 10:
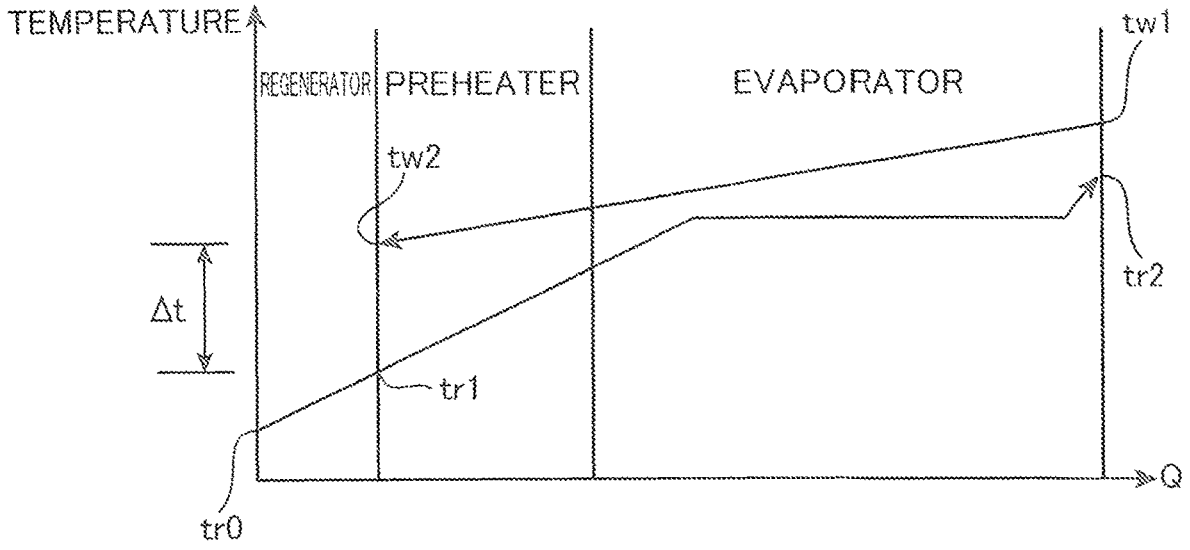
FIG. 10 is a graph showing temperature transitions of a working fluid and hot water in the reference example.

Here, a reference example for reducing the temperature difference Δt between the temperature tw2 of the hot water on the outlet side of the preheater 12 and the temperature tr1 of the working fluid on the inlet side of the preheater 12 is mentioned. As shown in FIG. 9, a regenerator 58 is provided between a pump 20 and the preheater 12 in a circulation flow path 22. This regenerator 58 heats the working fluid flowing from the pump 20 toward the preheater 12 by the working fluid discharged from an expander 14 and flowing toward a condenser 18. In this way, the temperature difference Δt in the preheater 12 can be reduced by increasing the temperature of the working fluid before flowing into the preheater 12. Specifically, as shown in FIG. 10, if the temperature of the working fluid discharged from the pump 20 is tr0, this temperature reaches a temperature tr1 since the working fluid is heated by the regenerator 58 before flowing into the preheater 12. As a result, the temperature difference Δt between the temperature tw2 of the hot water on the outlet side of the preheater 12 and the temperature tr1 of the working fluid on the inlet side of the preheater 12 is reduced.

SUMMARY OF EMBODIMENTS

Here, the above embodiments are outlined.

(1) A thermal energy recovery device of the above embodiment includes a working fluid circulation flow path for circulating a working fluid, a thermal fluid circulation flow path for circulating a pressurized heating fluid in a liquid state, an evaporation unit for evaporating the working fluid flowing in the working fluid circulation flow path by heat of the heating fluid flowing in the thermal fluid circulation flow path, and a control unit for controlling a startup operation of the thermal energy recovery device. The control unit executes a suppression control for suppressing a temperature difference between the heating fluid and the working fluid in the evaporation unit in the startup operation.

In the above recovery device, since the pressurized heating fluid in a liquid state flows into the evaporation unit, thermal energy introduced to the evaporation unit is large. In the evaporation unit, heat exchange is performed between the heating fluid in a liquid state introduced from the thermal fluid circulation flow path and the working fluid introduced from the working fluid circulation flow path. Thus, in the startup operation in which the temperature of the working fluid is relatively low, the suppression control is executed to suppress the temperature difference between the heating fluid and the working fluid in the evaporation unit. Therefore, it can be suppressed that a large thermal stress is generated in the evaporation unit during the startup operation.

(2) The suppression control may be a control for setting a temperature difference between the heating fluid flowing out from the evaporation unit and the working fluid flowing into the evaporation unit equal to or lower than a predetermined temperature set in advance when the temperature of the heating fluid flowing into the evaporation unit is equal to or higher than a temperature set in advance.

In this mode, an input heat quantity in the evaporation unit is so suppressed that a temperature difference between the temperature of the heating fluid on an outlet side of the evaporation unit and the temperature of the working fluid on an inlet side of the evaporation unit becomes equal to or lower than the predetermined temperature when the temperature of the heating fluid is equal to or higher than the predetermined temperature set in advance. Thus, it can be reliably suppressed that the thermal stress in the evaporation unit becomes excessive during the startup operation. Specifically, the temperature difference between the temperature of the heating fluid on the outlet side and the temperature of the working fluid on the inlet side is largest in the evaporation unit. Thus, by executing the suppression control on the basis of this temperature difference between the both, it can be reliably suppressed that the thermal stress in the evaporation unit becomes excessive.

(3) The above thermal energy recovery device may include a heater provided in the thermal fluid circulation flow path for heating the heating fluid with heat of a heating medium in a gas state and a flow rate control valve for adjusting a flow rate of the heating medium introduced into the heater. In this case, the control unit may adjust an opening of the flow rate control valve such that the temperature difference between the heating fluid flowing out from the evaporation unit and the working fluid flowing into the evaporation unit is maintained to be equal to or lower than the predetermined temperature in the startup operation.

In this mode, the temperature difference is maintained to be equal to or lower than the predetermined temperature by the control unit adjusting the opening of the flow rate control valve in the startup operation. Thus, it can be suppressed that the thermal stress in the evaporation unit becomes excessive by a simple operation of adjusting the opening of the flow rate control valve.

(4) The above thermal energy recovery device may include a cooler for cooling the heating fluid flowing in the thermal fluid circulation flow path with a cooling medium. In this case, the control unit may operate the cooler to suppress the temperature difference between the heating fluid and the working fluid in the evaporation unit.

In this mode, the control unit operates the cooler, for example, when the temperature difference between the heating fluid and the working fluid in the evaporation unit exceeds the predetermined temperature. In this way, the temperature of the heating fluid flowing in the thermal fluid circulation flow path decreases. Thus, the temperature difference between the heating fluid and the working fluid in the evaporation unit can be reduced.

(5) The evaporation unit may include an evaporator for evaporating the working fluid by the heat of the heating fluid flowing in the thermal fluid circulation flow path and a preheater for heating the working fluid before flowing into the evaporator by the heat of the heating fluid flowing in the thermal fluid circulation flow path.

In this mode, thermal energy introduced to the preheater may increase, but the suppression control for suppressing the temperature difference between the heating fluid and the working fluid is executed in the startup operation. Thus, even if the temperature of the working fluid in the preheater is relatively low before the startup operation, a sudden temperature increase of the preheater can be suppressed. Therefore, a sudden increase of a thermal stress generated in the preheater at the start of the operation can be suppressed.

(6) A startup operation method for thermal energy recovery device of the above embodiment is a startup operation method for thermal energy recovery device with an evaporation unit for evaporating working fluid flowing in a working fluid circulation flow path by heat of a heating fluid flowing in a thermal fluid circulation flow path, wherein a suppression control for suppressing a temperature of the working fluid in the evaporation unit is executed in a startup operation of the thermal energy recovery device.

(7) A heater for heating the heating fluid by heat of a heating medium in a gas state may be provided in the thermal fluid circulation flow path. In this case, in the above startup operation method for thermal energy recovery device, an opening of a flow rate control valve for adjusting a flow rate of the heating medium introduced into the heater may be adjusted such that a temperature difference between the heating fluid flowing out from the evaporation unit and the working fluid flowing into the evaporation unit is maintained to be equal to or lower than the predetermined temperature.

(8) A cooler for cooling the heating fluid flowing in the thermal fluid circulation flow path by a cooling medium may be provided. In this case, the above startup operation method for thermal energy recovery device may include operating the cooler to suppress the temperature difference between the heating fluid and the working fluid in the evaporation unit if the temperature difference between the heating fluid flowing out from the evaporation unit and the working fluid flowing into the evaporation unit exceeds a temperature set in advance.

As described above, a sudden increase of a thermal stress generated in the evaporation unit at the start of the operation can be suppressed.

The invention claimed is:

1. A thermal energy recovery device, comprising:

a working fluid circulation flow path for circulating a working fluid;

a thermal fluid circulation flow path for circulating a pressurized heating fluid in a liquid state;

an evaporation unit for evaporating the working fluid flowing in the working fluid circulation flow path by heat of the heating fluid flowing in the thermal fluid circulation flow path; and a control unit for controlling a startup operation of the thermal energy recovery device;

the control unit executing a suppression control for suppressing a temperature difference between the heating fluid and the working fluid in the evaporation unit in the startup operation, wherein the suppression control is a control for setting a temperature difference between the heating fluid flowing out from the evaporation unit and the working fluid flowing into the evaporation unit equal to or lower than a predetermined temperature set in advance when the temperature of the heating fluid flowing into the evaporation unit is equal to or higher than a temperature set in advance.

2. A thermal energy recovery device according to claim 1, wherein the evaporation unit includes an evaporator for evaporating the working fluid by the heat of the heating fluid flowing in the thermal fluid circulation flow path and a preheater for heating the working fluid before flowing into the evaporator by the heat of the heating fluid flowing in the thermal fluid circulation flow path.

3. A thermal energy recovery device comprising:

a working fluid circulation flow path for circulating a working fluid;

a thermal fluid circulation flow path for circulating a pressurized heating fluid in a liquid state;

an evaporation unit for evaporating the working fluid flowing in the working fluid circulation flow path by heat of the heating fluid flowing in the thermal fluid circulation flow path;

a control unit for controlling a startup operation of the thermal energy recovery device, the control unit executing a suppression control for suppressing a temperature difference between the heating fluid and the working fluid in the evaporation unit in the startup operation;

a heater provided in the thermal fluid circulation flow path for heating the heating fluid with heat of a heating medium in a gas state; and a flow rate control valve for adjusting a flow rate of the heating medium introduced into the heater;

wherein the control unit adjusts an opening of the flow rate control valve such that the temperature difference between the heating fluid flowing out from the evaporation unit and the working fluid flowing into the evaporation unit is maintained to be equal to or lower than the predetermined temperature in the startup operation.

4. A thermal energy recovery device comprising a working fluid circulation flow path for circulating a working fluid;

a thermal fluid circulation flow path for circulating a pressurized heating fluid in a liquid state;

an evaporation unit for evaporating the working fluid flowing in the working fluid circulation flow path by heat of the heating fluid flowing in the thermal fluid circulation flow path;

a control unit for controlling a startup operation of the thermal energy recovery device, the control unit executing a suppression control for suppressing a temperature difference between the heating fluid and the working fluid in the evaporation unit in the startup operation; and a cooler for cooling the heating fluid flowing in the thermal fluid circulation flow path with a cooling medium, wherein the control unit operates the cooler to suppress the temperature difference between the heating fluid and the working fluid in the evaporation unit.

* * * * *